US007246718B2

(12) United States Patent
Einav et al.

(10) Patent No.: US 7,246,718 B2
(45) Date of Patent: Jul. 24, 2007

(54) TOOLBOX WITH HANDLE HAVING COVER LOCKING MECHANISM

(75) Inventors: Yehuda Einav, Nes Tziona (IL); Amir Katz, Bat Hefer (IL); Ronny Levy, Tel Aviv (IL)

(73) Assignee: Zag Industries Ltd., Rosh Ha' Ayin (IL)

( * ) Notice: Subject to any disclaimer, the term of this patent is extended or adjusted under 35 U.S.C. 154(b) by 124 days.

(21) Appl. No.: 10/676,148

(22) Filed: Oct. 2, 2003

(65) Prior Publication Data

US 2005/0072789 A1 Apr. 7, 2005

(51) Int. Cl.
*B65D 25/10* (2006.01)

(52) U.S. Cl. ..... 220/764

(58) Field of Classification Search ..... 220/315, 220/318, 756, 764
See application file for complete search history.

(56) References Cited

U.S. PATENT DOCUMENTS

| | | | | | |
|---|---|---|---|---|---|
| 1,142,699 | A | * | 6/1915 | Gustafson | 220/212.5 |
| 1,364,826 | A | * | 1/1921 | Babin | 220/318 |
| 1,472,707 | A | * | 10/1923 | Weisz | 220/264 |
| 1,859,228 | A | * | 5/1932 | Berry | 220/318 |
| 2,879,916 | A | * | 3/1959 | Hoffmann et al. | 220/322 |
| 4,351,448 | A | | 9/1982 | Ingersoll et al. | 220/318 |
| D296,065 | S | * | 6/1988 | Tarozzi et al. | D7/605 |
| 4,982,863 | A | * | 1/1991 | Skillius | 220/318 |
| 4,984,687 | A | | 1/1991 | Hanna et al. | |
| 5,226,553 | A | * | 7/1993 | Fiore | 220/318 |
| 5,238,142 | A | | 8/1993 | Hanna et al. | |
| 6,131,237 | A | * | 10/2000 | Kasper et al. | 15/320 |
| 6,155,616 | A | | 12/2000 | Akright | |
| 6,237,765 | B1 | * | 5/2001 | Hagen et al. | 206/315.11 |
| 6,415,786 | B1 | * | 7/2002 | Kolbe et al. | 128/200.24 |
| 6,484,880 | B1 | * | 11/2002 | Shaeffer | 206/581 |
| D496,531 | S | * | 9/2004 | Einav et al. | D3/276 |

FOREIGN PATENT DOCUMENTS

| | | |
|---|---|---|
| EP | 0 668 129 A1 | 8/1995 |
| EP | 1 520 660 A3 | 5/2006 |
| GB | 2 306 553 A | 5/1997 |
| WO | WO 99/52769 | 10/1999 |

OTHER PUBLICATIONS

European Search Report issued for European Patent Application 04256122.5-2316 dated Mar. 23, 2006.

* cited by examiner

*Primary Examiner*—Stephen Castellano
(74) *Attorney, Agent, or Firm*—Pillsbury Winthrop Shaw Pittman LLP

(57) ABSTRACT

A container includes a base having a bottom wall and side walls defining an interior storage compartment. At least one of the side walls has a locking element. A cover is movably mounted to the base for movement between an open position in which access to the interior storage compartment is permitted and a closed position in which access to the interior storage compartment is prevented. A handle includes a handle portion and a cover locking mechanism. The handle is movably mounted to the cover so that the handle is movable to move the cover locking mechanism thereof into interlocking engagement with the locking element provided on the base to lock the cover in the closed position.

19 Claims, 20 Drawing Sheets

TOOLBOX WITH HANDLE HAVING COVER LOCKING MECHANISM

BACKGROUND OF THE INVENTION

1. Field of the Invention

The present invention relates to containers. More specifically, the present invention relates to portable containers, such as toolboxes, having a handle and a locking mechanism for locking a cover of the portable container in a closed position.

2. Description of Related Art

Known portable containers, such as toolboxes, have a base and a cover pivotally attached thereto for movement between an open position in which access to an interior space of the base is permitted and a closed position in which access to the interior space is prevented. In some arrangements, locking mechanisms in the form of latches are provided on one of the cover and the base to secure the cover in the closed position. An example of a conventional locking mechanism is disclosed in U.S. Pat. No. 5,238,142.

To facilitate carrying the container, a handle is typically provided on the cover. The handle is usually entirely separate from the locking mechanisms. Thus, it is possible to inadvertently unlatch the cover when carrying the container by the handle, causing the contents to spill out.

It would be desirable to design a container that cannot be opened while being carried by the handle.

SUMMARY OF THE INVENTION

One aspect of the present invention is to provide an improved locking mechanism for locking the cover of a container in a closed position.

Another aspect of the present invention is to provide a container handle that includes a locking mechanism for locking the cover of the container in a closed position.

In accordance with the principles of the present invention, these aspects may be achieved by providing a container including a base having a bottom wall and side walls defining an interior storage compartment. At least one of the side walls has a locking element. A cover is movably mounted to the base for movement between an open position in which access to the interior storage compartment is permitted and a closed position in which access to the interior storage compartment is prevented. A handle includes a handle portion and a cover locking mechanism. The handle is movably mounted to the cover so that the handle is movable to move the cover locking mechanism thereof into interlocking engagement with the locking element provided on the base to lock the cover in the closed position.

These and other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE PREFERRED EMBODIMENTS

This invention is directed to a storage container that is portable by virtue of a handle and has an interior compartment. While the container is described as a toolbox for purposes of illustration, it is not intended to be limited to a toolbox. The container could be a tackle box, a jewelry box, a cooler, a make-up case, luggage, or any type of container, especially a hand-carried container.

In the illustrated embodiment, the toolbox 10 is used for storing and accessing items such as work tools, e.g., hammers, drills, screwdrivers, wrenches, etc., and work accessories, e.g., nails, screws, nuts, bolts, etc. However, it should be understood that the toolbox 10 could be used as a portable storage container for any other suitable items, e.g., art supplies. Thus, the reference to a "toolbox" used herein is intended to generically cover any portable storage container, as noted above.

Figure 1:
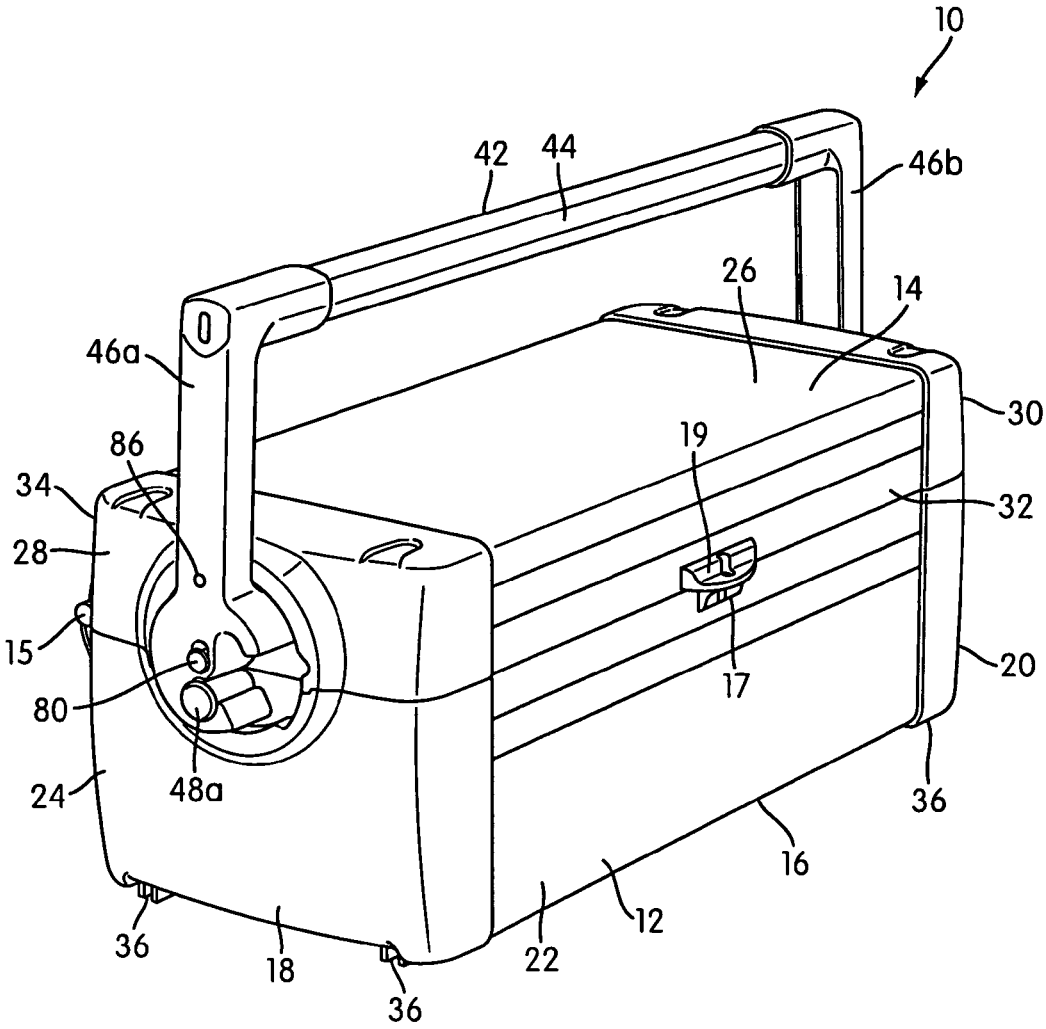
FIG. 1 is a side perspective view of a toolbox constructed in accordance with an embodiment of the invention, the cover of the toolbox in a closed position and the handle of the toolbox in an upright locked position.
Figure 6:
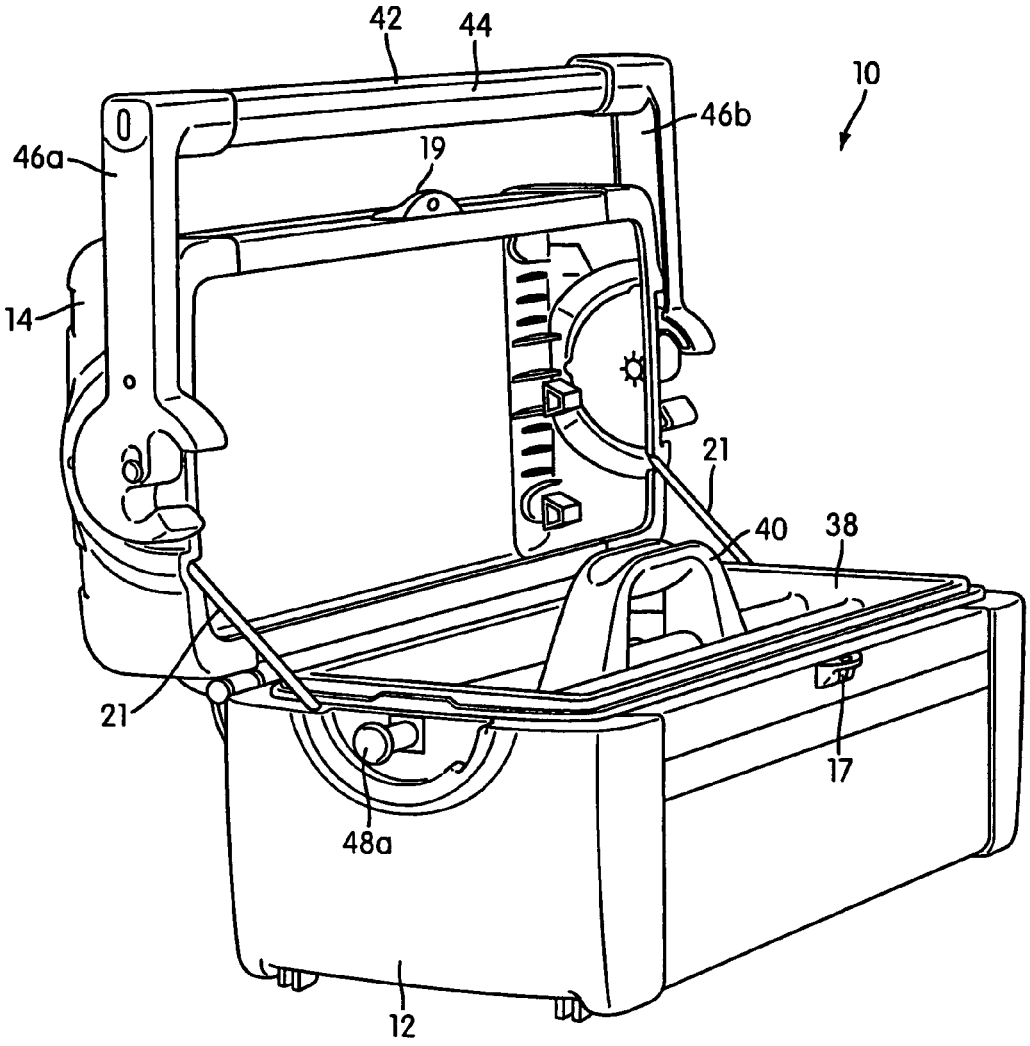
FIG. 6 is a side perspective view of the toolbox shown in FIG. 1 with the cover in an open position.
Figure 7:
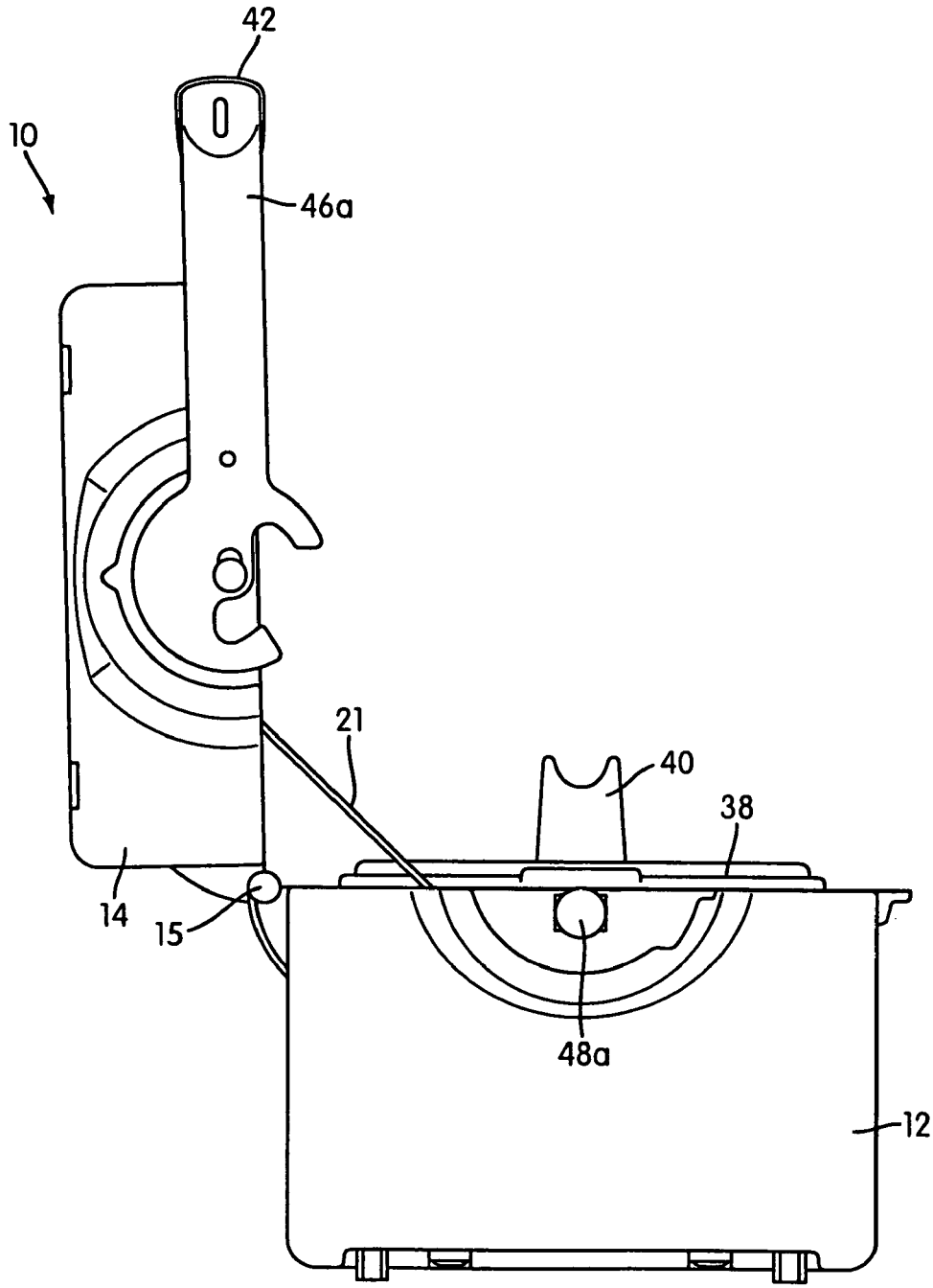
FIG. 7 is a side view of the toolbox shown in FIG. 6.

FIG. 1 illustrates a toolbox 10 constructed in accordance with one illustrated embodiment of the present invention. In the illustrated embodiment, the toolbox 10 includes a base 12 and a cover 14 pivotally mounted to the base, e.g., by a hinge 15, for movement between an open position (as shown in FIGS. 6–7) and a closed covering position (as shown in FIGS. 1–5 and 8–9) with respect to the base 12.

The base 12 includes a bottom wall 16 and four side walls 18, 20, 22, 24 extending from each edge of the bottom wall 16. The bottom wall 16 and side walls 18, 20, 22, 24 define an interior storage compartment. The cover 14 has a top wall 26 and four side walls 28, 30, 32, 34 extending from each edge of the top wall 26. The top wall 26 and side walls 28, 30, 32, 34 form an internal compartment. The interior storage compartment of the base 12 and the internal compartment of the cover 14 join to form an interior storage space. When the cover 14 is in the open position, access to the interior storage space is permitted. Likewise, when the cover 14 is in the closed position, access to the interior storage space is prevented.

In the illustrated embodiment, the base 12 and the cover 14 are constructed of molded plastic. However, the base 12 and the cover 14 may be constructed of any other suitable material, such as metal, wood or composites.

Figure 4:
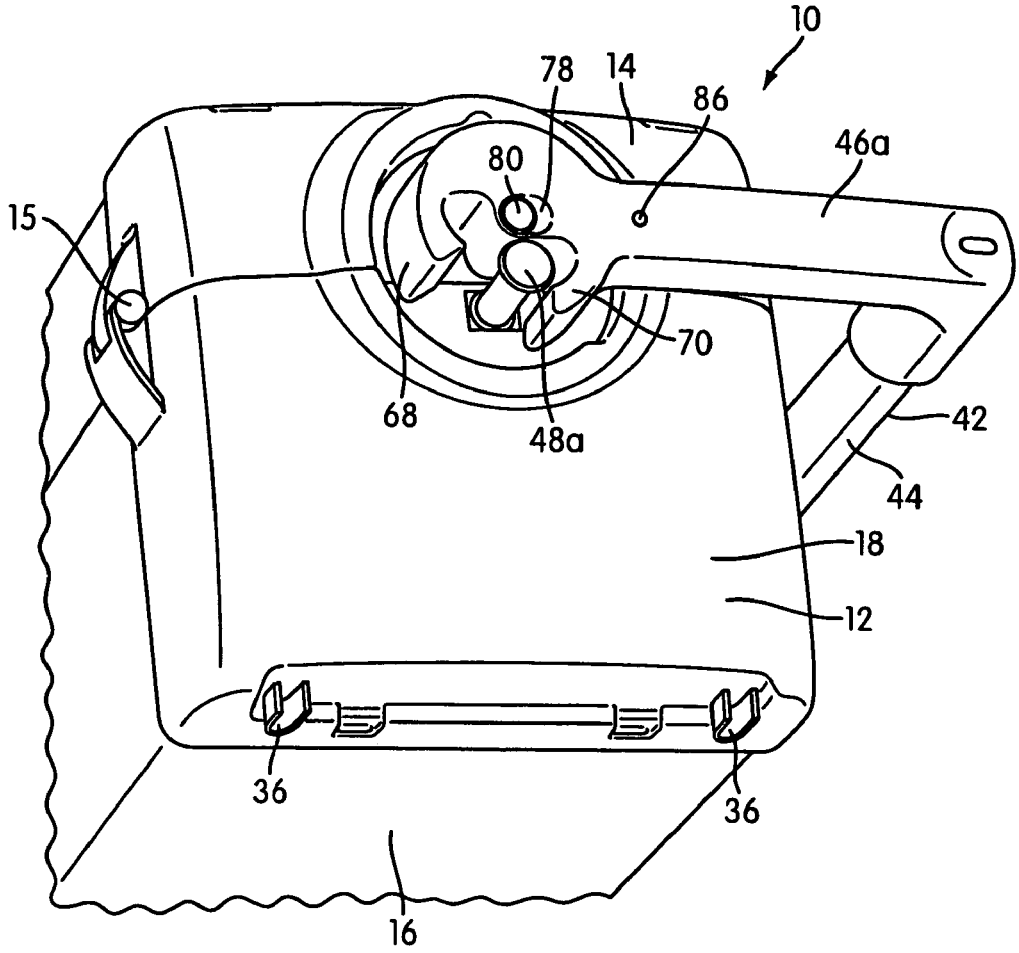
FIG. 4 is an enlarged side perspective view of the toolbox shown in FIG. 3.
Figure 5:
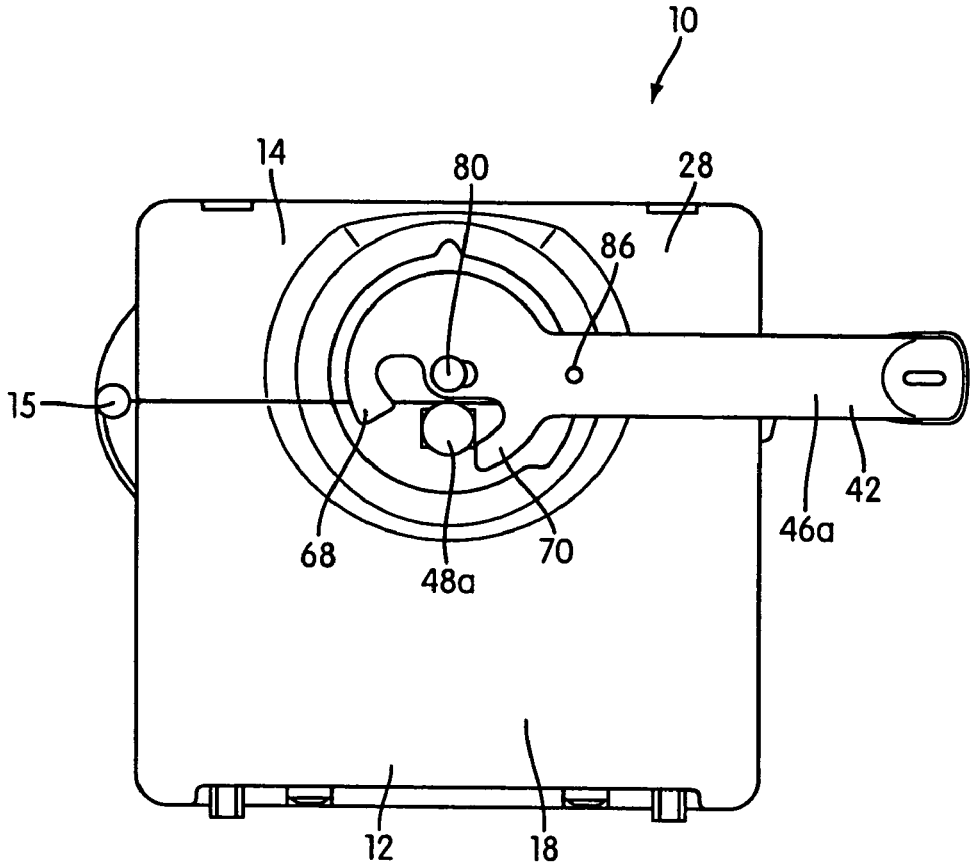
FIG. 5 is a side view of the toolbox shown in FIG. 3.
Figure 8:
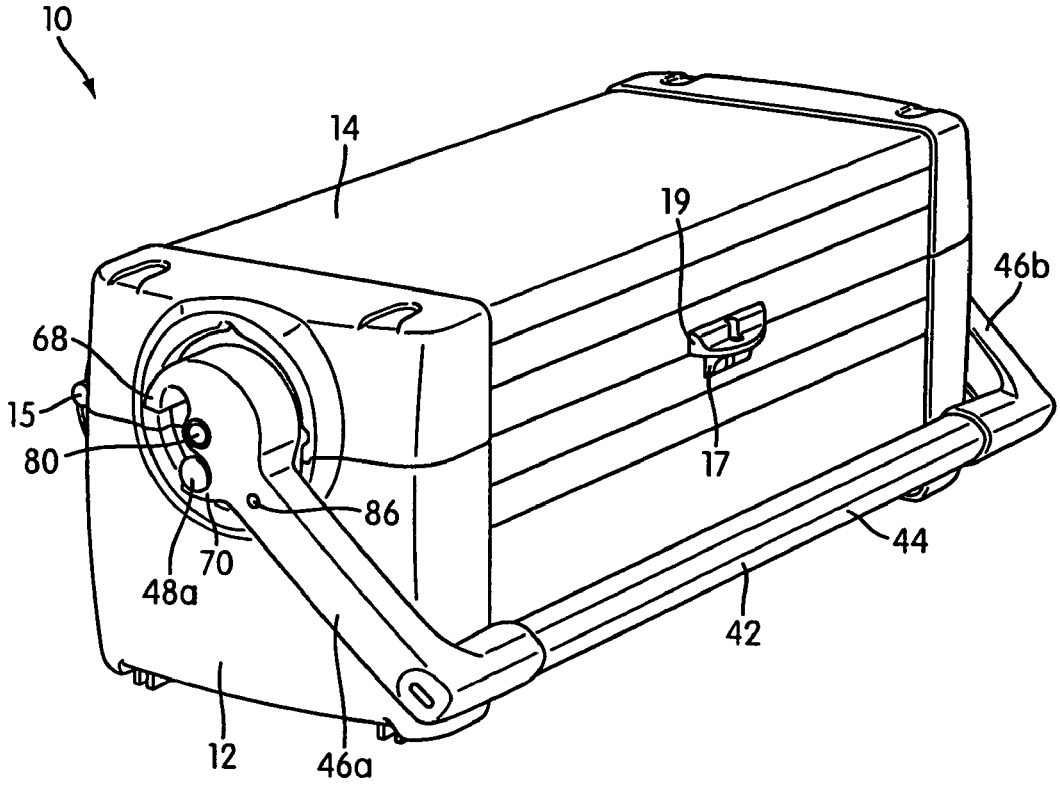
FIG. 8 is a perspective view of the toolbox shown in FIG. 1 with the cover thereof in a closed position and the handle in a folded locked position.
Figure 9:
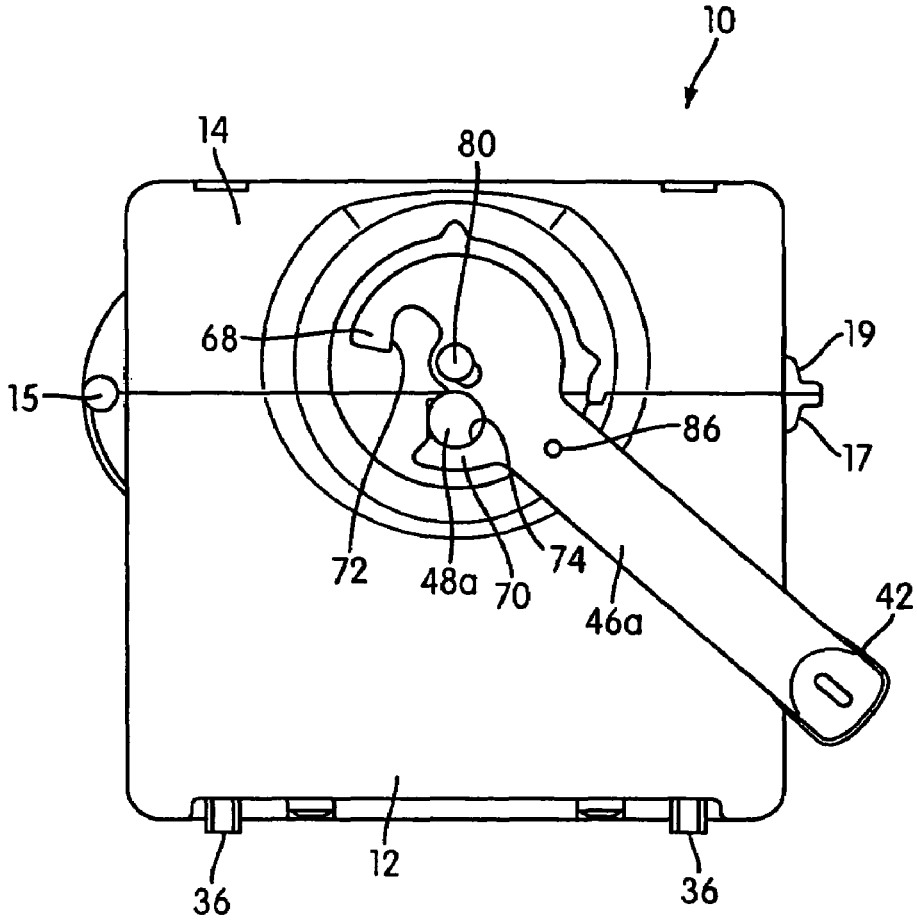
FIG. 9 is a side view of the toolbox shown in FIG. 8.
Figure 10:
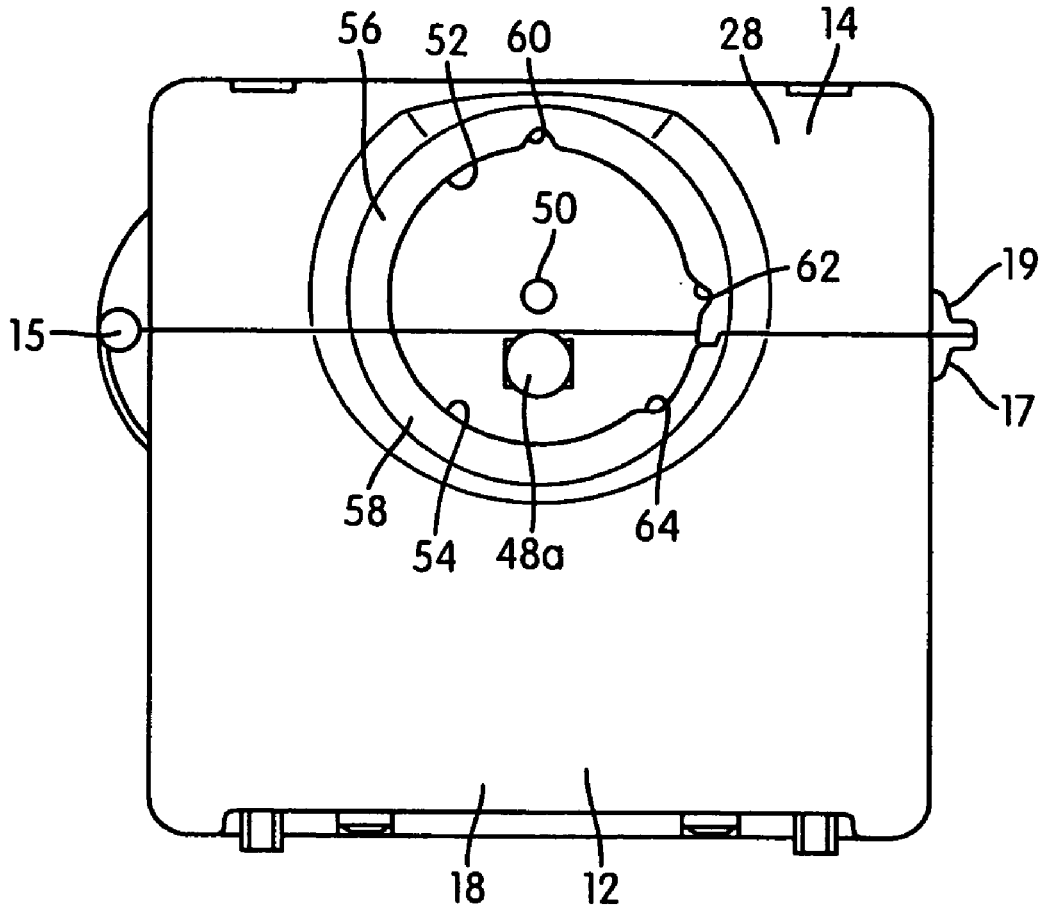
FIG. 10 is a side view of the toolbox shown in FIG. 1 with the cover in a closed position and the handle removed.

As best shown in FIG. 4, the bottom wall 16 of the base 12 has a plurality of protrusions 36 to slightly elevate the bottom wall 16 from a support surface, thereby protecting the bottom wall 16. Also, as best shown in FIGS. 8–10, the base 12 includes a first tab 17 and the cover 14 includes a second tab 19. When the cover 14 is in the closed covering position, the user may insert a lock through aligned openings provided in the tabs 17, 19 to secure the cover 14 in the closed position for security purposes. The base 12 and cover 14 may include additional protrusions and/or recesses, e.g., for aesthetics and for adding rigidity to the toolbox 10.

As shown in FIGS. 6–7, a removable tray 38, for storing work tools for example, is removably mounted in the interior storage compartment of the base 12. The removable tray 38 includes a handle 40 and can be lifted away from the toolbox 10 to hold and transfer work tools. When contained within the toolbox 10, the removable tray 38 is disposed within the base 12 and rests on protrusions that are formed in the side walls of the base 12.

Also, as shown in FIGS. 6–7, cables 21 may be attached between the base 12 and the cover 14 to limit the range of pivotal movement of the cover 14 with respect to the base 12. That is, the cables 21 stop the cover 14 at a predetermined open position. However, these cables 21 are optional and may not be provided on the toolbox 10. Also, a stop structure may be provided in the hinge 15 between the base 12 and the cover 14 to limit the range of pivotal movement.

A handle 42 is pivotally mounted to the cover 14. The handle 42 includes a handle portion 44 and cover locking mechanisms 46*a*, 46*b* mounted to ends of the handle portion 44. The handle 42 is preferably made of a lightweight metal, such as aluminum, to provide strength and durability. However, any material may be used.

The handle 42 is rotatably mounted to the cover 14. Movement of the handle 42 moves the cover locking mechanisms 46*a*, 46*b* thereof into interlocking engagement with respective locking elements 48*a*, 48*b* provided on the base 12 to lock the cover 14 in the closed covering position. Specifically, the handle 42 is pivotally mounted to the cover 14 for movement between an unlocked position in which the cover locking mechanisms 46*a*, 46*b* thereof are disengaged from the locking elements 48*a*, 48*b* on the base 12 to allow movement of the cover 14 between the open and closed positions thereof, and at least one locked position in which the cover locking mechanisms 46*a*, 46*b* thereof are in interlocking engagement with the locking elements 48*a*, 48*b* on the base 12 to lock the cover 14 in the closed covering position.

Figure 2:
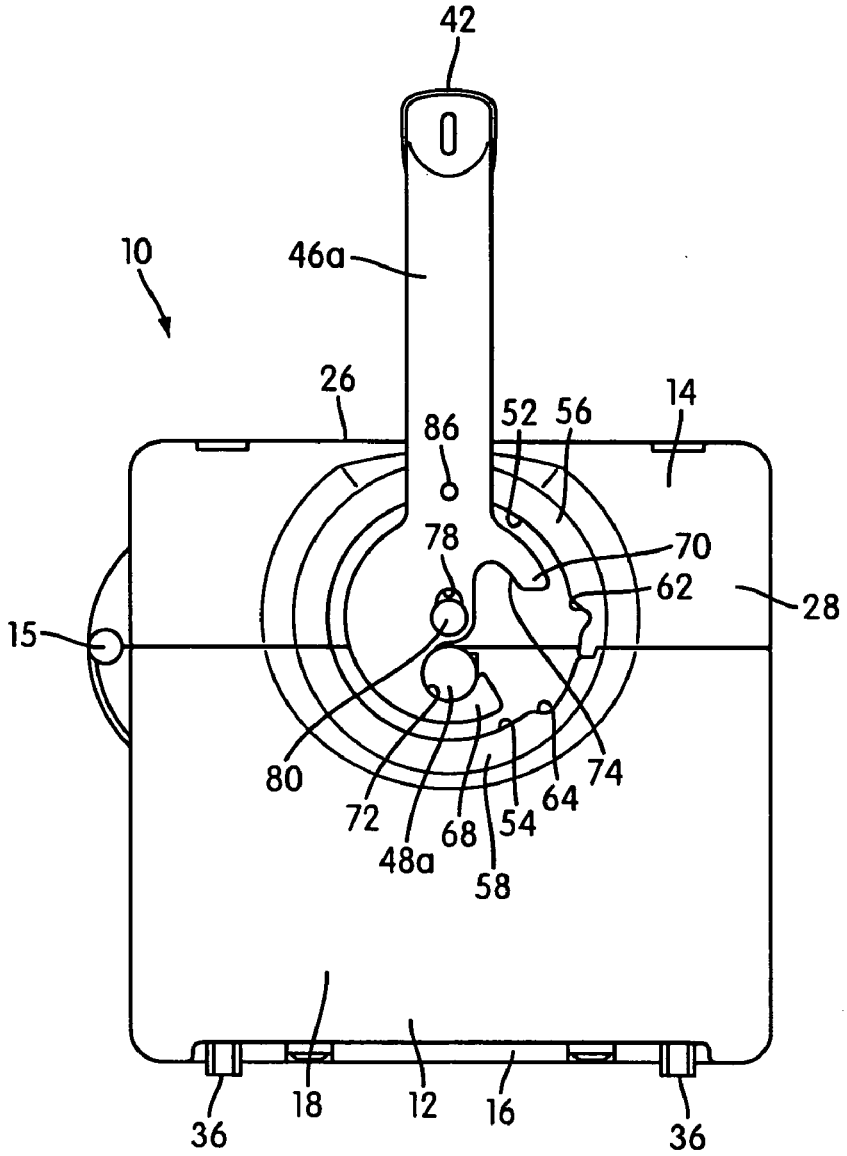
FIG. 2 is a side view of the toolbox shown in FIG. 1.
Figure 3:
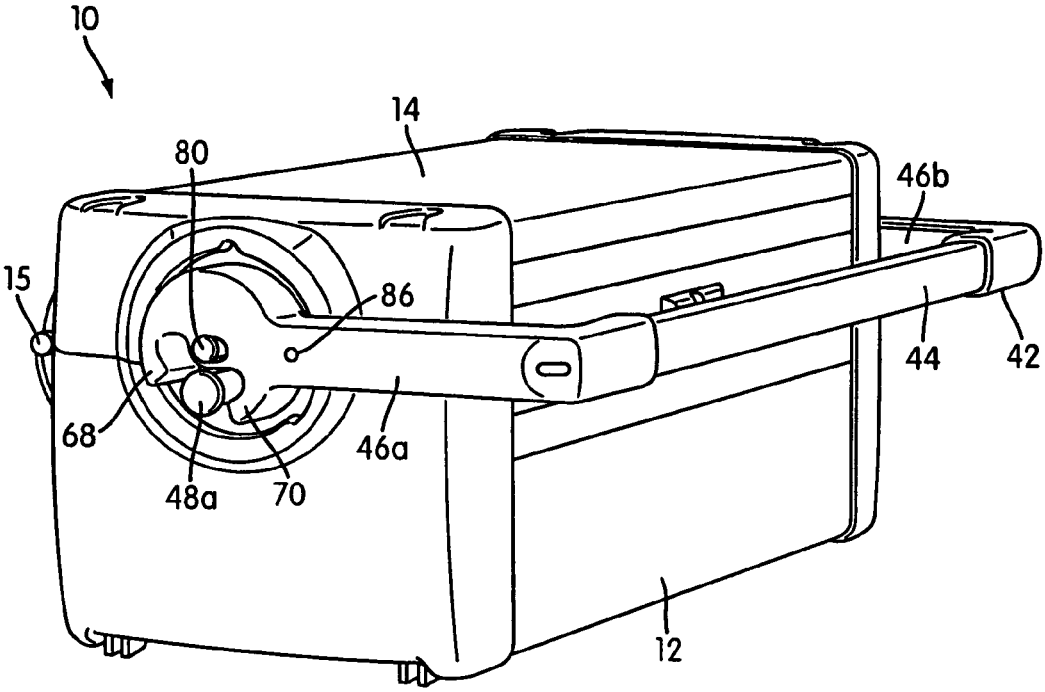
FIG. 3 is a side perspective view of the toolbox shown in FIG. 1 with the cover thereof in a closed position and the handle thereof in an intermediate unlocked position.

In the illustrated embodiment, the handle 42 is pivotally mounted to the cover 14 for movement between three positions. That is, the handle 42 is pivotally movable between a vertical, upright locked position (as shown in FIGS. 1 and 2), a horizontal, intermediate unlocked position (as shown in FIGS. 3–7), and a downward, folded locked position (as shown in FIGS. 8 and 9). In the vertical, upright locked position, the handle portion 44 is in a vertical, upright position for carrying by a user, and the cover locking mechanisms 46*a*, 46*b* are in interlocking engagement with the locking elements 48*a*, 48*b* on the base 12 to lock the cover 14 in the closed covering position. In the horizontal, intermediate unlocked position, the handle portion 44 is rotated into a horizontal orientation to facilitate opening and closing of the cover 14, and the cover locking mechanisms 46*a*, 46*b* are disengaged from the locking elements 48*a*, 48*b* on the base 12 to allow movement of the cover 14 between the open and closed positions thereof. In the downward, folded locked position, the handle portion 44 is retracted downward into a folded inclined position for storage purposes, and the cover locking mechanisms 46*a*, 46*b* are in interlocking engagement with the locking elements 48*a*, 48*b* on the base 12 to lock the cover 14 in the closed covering position.

As shown in FIG. 10, opposing side walls 28, 30 of the cover 14 each include a handle mounting opening 50. Also, as best shown in FIGS. 6 and 10, opposing side walls 18, 20 of the base 12 include respective locking elements 48*a*, 48*b*. In the illustrated embodiment, the locking elements 48*a*, 48*b* are in the form of a locking pin that extends laterally outwardly from the respective side wall 18, 20. The locking pins 48*a*, 48*b* on the side walls 18, 20 can be integrally formed with the base 12 or can be formed separately and rigidly attached thereto in any suitable manner.

Further, as shown in FIG. 10, the cover 14 defines a first inwardly facing arcuate guide surface 52 and the base 12 defines a second inwardly facing arcuate guide surface 54. When the cover 14 is in the closed position, the guide surfaces 52, 54 of the cover 14 and the base 12 cooperate to define a generally circular guide surface. In the illustrated embodiment, the cover 14 and the base 12 include a respective protruding portion 56, 58 that define the respective inwardly facing arcuate guide surface 52, 54. Also, the guide surfaces 52, 54 provide three locating notches 60, 62, 64 that define the three positions of the handle 42, i.e., the upright locked position, the intermediate unlocked position, and the folded locked position, as will be further discussed. Specifically, the guide surface 52 of the cover 14 includes two locating notches 60, 62 and the guide surface 54 of the base 12 includes one locating notch 64.

Figure 11:
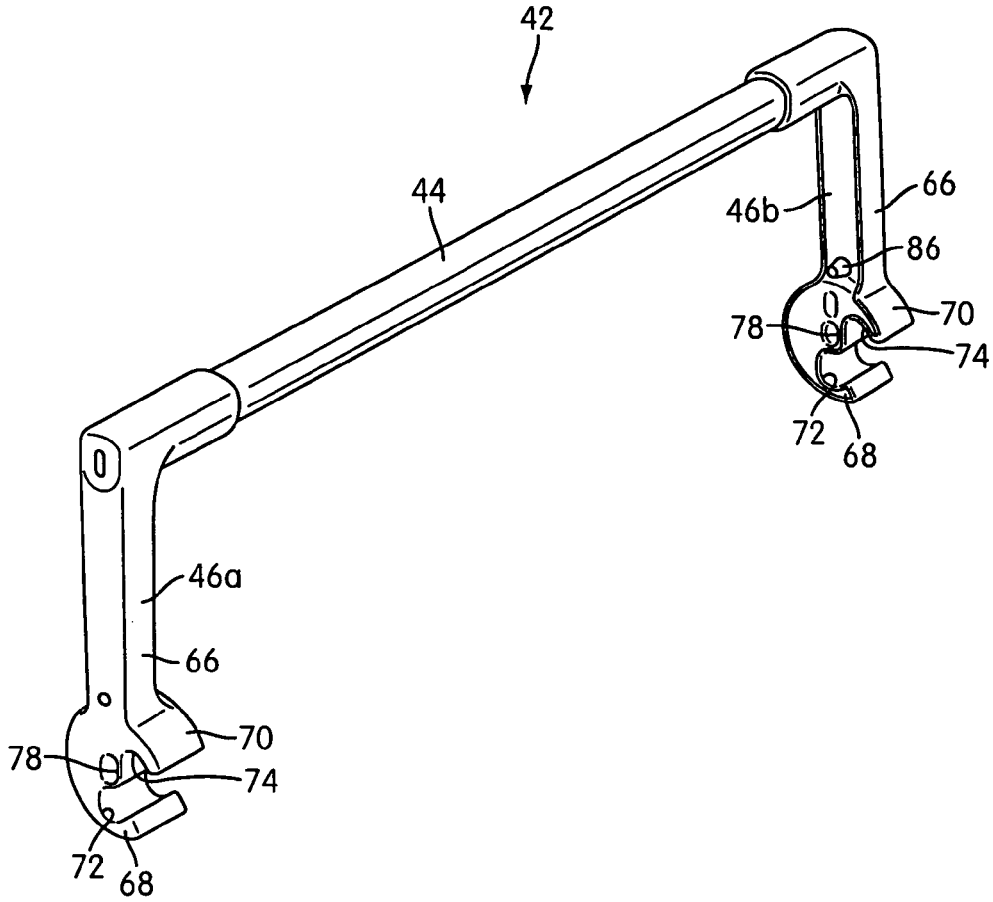
FIG. 11 is a perspective view of the handle of the toolbox shown in FIG. 1.

As shown in FIG. 11, the handle portion 44 of the handle 42 is in the form of an elongated tubular member having opposing longitudinal end portions. A first cover locking mechanism 46*a* is mounted to one of the end portions of the handle portion 44 and a second cover locking mechanism 46*b* is mounted to the other of the end portions of the handle portion 44. The first and second cover locking mechanisms 46*a*, 46*b* cooperate with a respective locking pin 48*a*, 48*b* provided on the base 12 to lock the cover 14 in the closed position, as will be further discussed.

Each cover locking mechanism 46*a*, 46*b* includes an L-shaped body 66 having a first end mounted to the respective end portion of the handle portion 44 and a second end. The second end includes first and second locking arms 68, 70 that define respective first and second recesses 72, 74. The second end also supports a handle locating assembly 76 that locates the handle 42 at discrete intervals in each of the upright locked position, the intermediate unlocked position, and the folded locked position, as will be further discussed.

Further, the second end includes an elongated recess 78 for pivotally mounting the respective cover locking mechanism 46*a*, 46*b*, and hence the handle 42, to the cover 14. Specifically, a pivot pin 80 extends through the elongated recess 78 of the respective cover locking mechanism 46*a*, 46*b* and into interlocking engagement with a respective handle mounting opening 50 provided in the cover 14. This allows the cover locking mechanisms 46*a*, 46*b*, and hence the handle 42, to pivot with respect to the cover 14 and the base 12 in use. Moreover, the elongated recess 78 of the cover locking mechanisms 46*a*, 46*b* allows the handle 42 to move linearly with respect to the base 12 and the cover 14 in use, as will be further discussed.

In use, the cover locking mechanisms 46*a*, 46*b* are rotated about the axis of the pivot pin 80 as the handle 42 is rotated between the upright locked position, the intermediate unlocked position, and the folded locked position. When the handle 42 is in the upright locked position, the locking pins 48*a*, 48*b* are received within a respective first recess 72 of the cover locking mechanisms 46*a*, 46*b* which prevents movement of the cover 14 with respect to the base 12. When the handle 42 is in the intermediate unlocked position, the locking pins 48*a*, 48*b* are positioned between the locking arms 68, 70 of the cover locking mechanisms 46*a*, 46*b* which allows movement of the cover 14 with respect to the base 12. When the handle 42 is in the folded locked position, the locking pins 48*a*, 48*b* are received within a respective second recess 74 of the cover locking mechanisms 46*a*, 46*b* which prevents movement of the cover 14 with respect to the base 12.

In the preferred embodiment as noted above, the handle portion 44 is formed of metal, e.g., aluminum, and the cover locking mechanisms 46*a*, 46*b* are formed of plastic. That is, the handle portion 44 and the cover locking mechanisms 46*a*, 46*b* are constructed separately and rigidly connected to one another in any suitable manner. However, the handle portion 44 and the cover locking mechanisms 46*a*, 46*b* may be integrally formed in one piece by any suitable method, e.g., molding.

Figure 12:
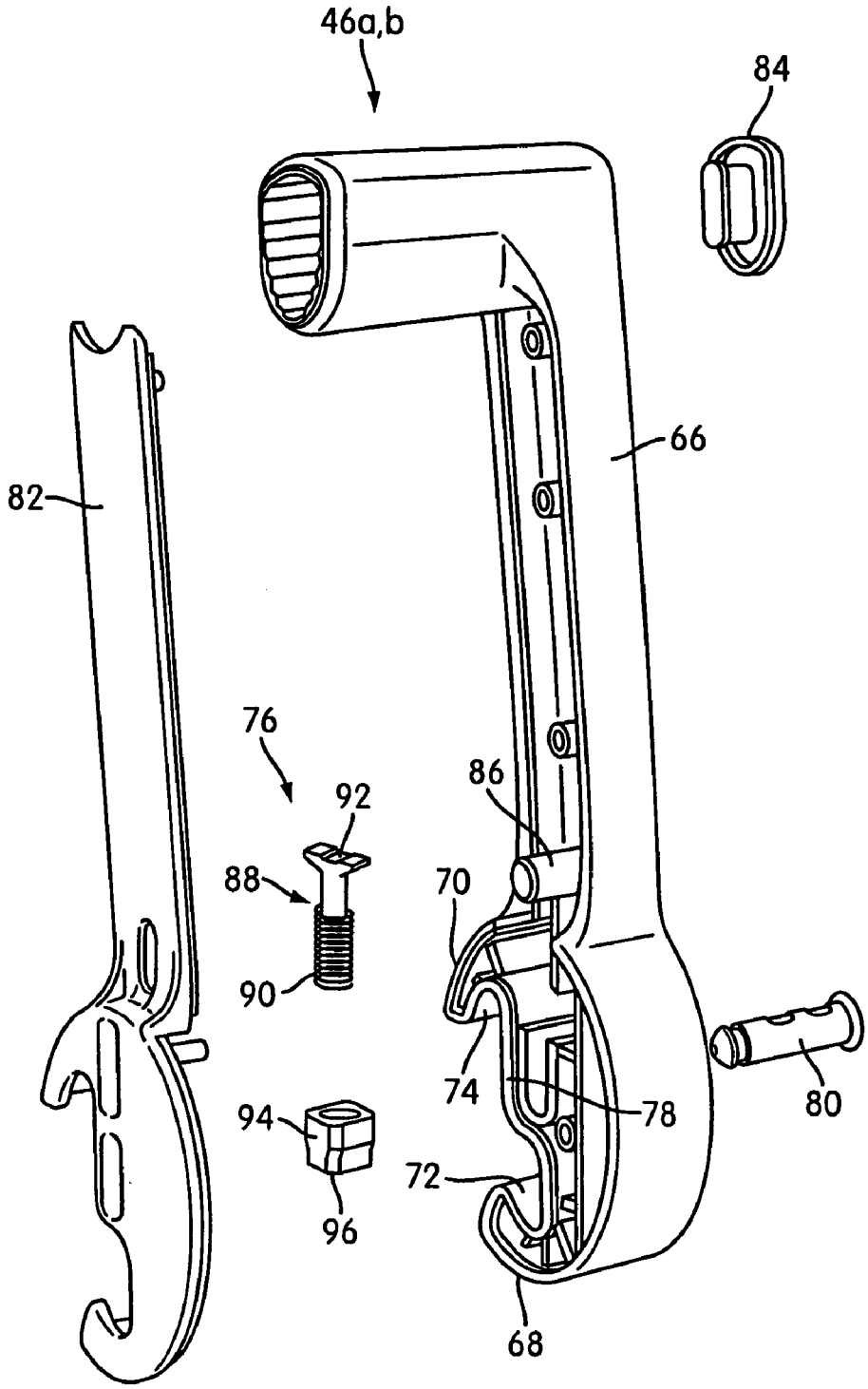
FIG. 12 is an exploded view of an embodiment of a cover locking mechanism of the handle shown in FIG. 11.
Figure 13:
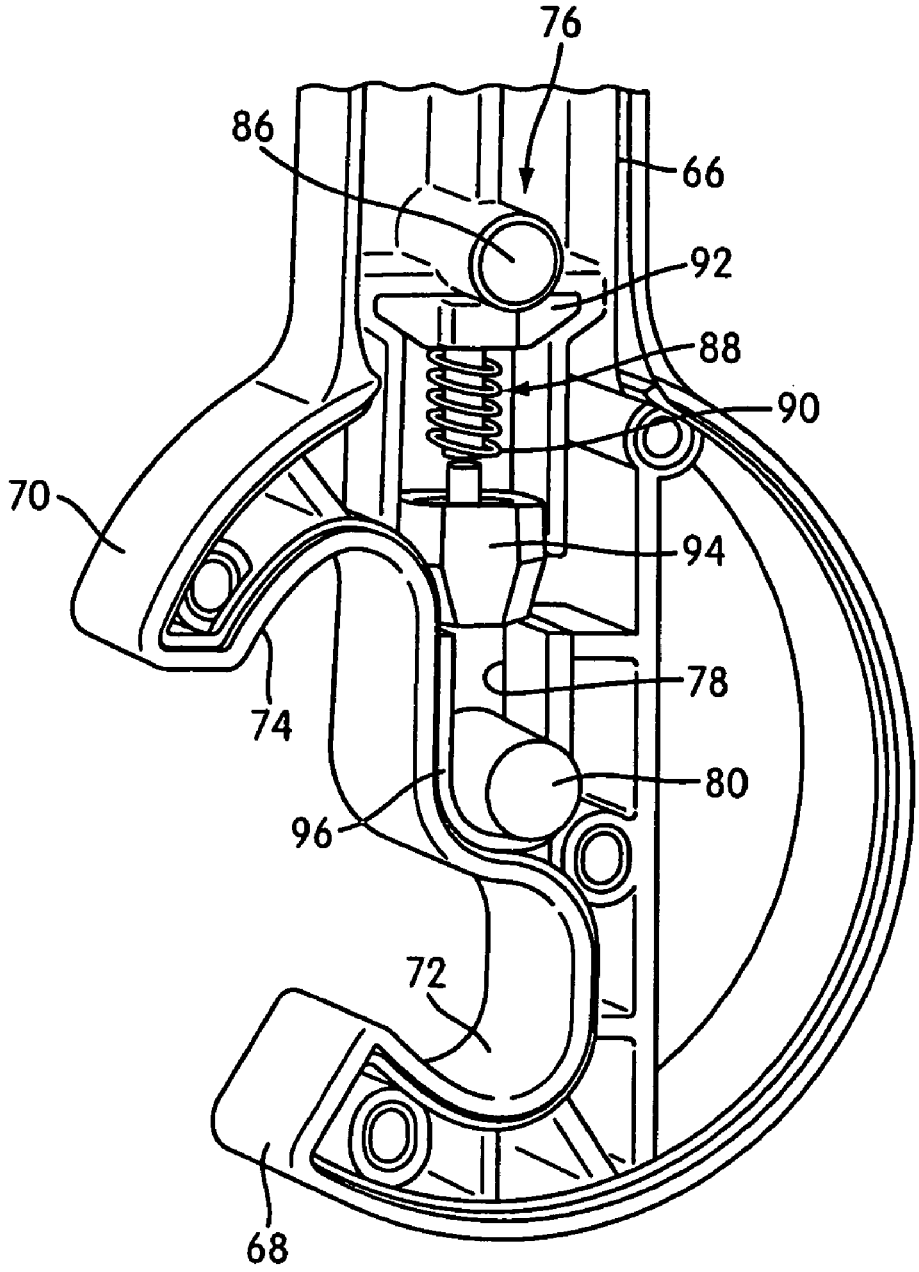
FIG. 13 is an enlarged interior side view of the cover locking mechanism shown in FIG. 12.

As shown in FIGS. 12 and 13, the handle locating assembly 76 is housed within an interior space of the body 66. A cover member 82 is secured to the body 66 to enclose the handle locating assembly 76 within the body 66. Also, an end cap 84 is secured to the first end of the body 66. The handle locating assembly 76 includes a locating pin 86 that extends inwardly from the body 66 and a biasing structure 88 positioned between the locating pin 86 and the pivot pin 80. The biasing structure 88 biases the locating pin 86 into engagement with the guide surfaces 52, 54 provided on the cover 14 and the base 12.

Specifically, the biasing structure 88 includes a spring 90, a spring base 92, and a spring arm 94. The spring base 92 is secured within the body 66 adjacent the locating pin 86 to support one end of the spring 90. The opposite end of the spring 90 is supported by the spring arm 94. The spring arm 94 is slidably received within the body 66 and is operatively engaged with the pivot pin 80, e.g., by a hook structure 96. As a result, the spring 90 biases the locating pin 86, and hence the handle 42, outwardly away from the pivot pin 80 such that the locating pin 86 engages with the guide surfaces 52, 54. The handle 42 is linearly movable with respect to the pivot pin 80, via the elongated recess 78, to allow linear movement of the locating pin 86 against biasing from the spring 90.

This linear movement allows the locating pin 86 to positively locate the handle 42 at discrete intervals in each of the three positions, i.e., the upright locked position, the intermediate unlocked position, and the folded locked position. As discussed above, the guide surfaces 52, 54 of the cover 14 and the base 12 provide three locating notches 60, 62, 64. As the handle 42 is rotated about the pivot pin 80 between the three positions, the locating pin 86 rides along the guide surfaces 52, 54 under biasing from the spring 90. When the locating pin 86 reaches one of the locating notches 60, 62, 64, biasing from the spring 90 forces the locating pin 86, and hence the entire handle 42, outwardly away from the pivot pin 80 such that the locating pin 86 engages within the respective locating notch 60, 62, 64 to positively locate the handle 42 in one of the three positions. That is, the locating pin 86 engages within a first locating notch 60 to locate the handle 42 in the upright locked position, the locating pin 86 engages within a second locating notch 62 to locate the handle 42 in the intermediate unlocked position, and the locating pin 86 engages within a third locating notch 64 to locate the handle 42 in the folded locked position. The user applies sufficient force to the handle 42 to force the locating pin 86 out of the respective locating notch 60, 62, 64 against biasing from the spring 90 to move the handle 42 between positions.

Thus, the cover locking mechanisms 46*a*, 46*b* of the handle 42 provide a combination of linear and concentric motion about the pivot axis of the handle 42. That is, as the handle 42 reaches one of the three positions, the motion is linear, but between these positions the motion is concentric.

Figure 14:
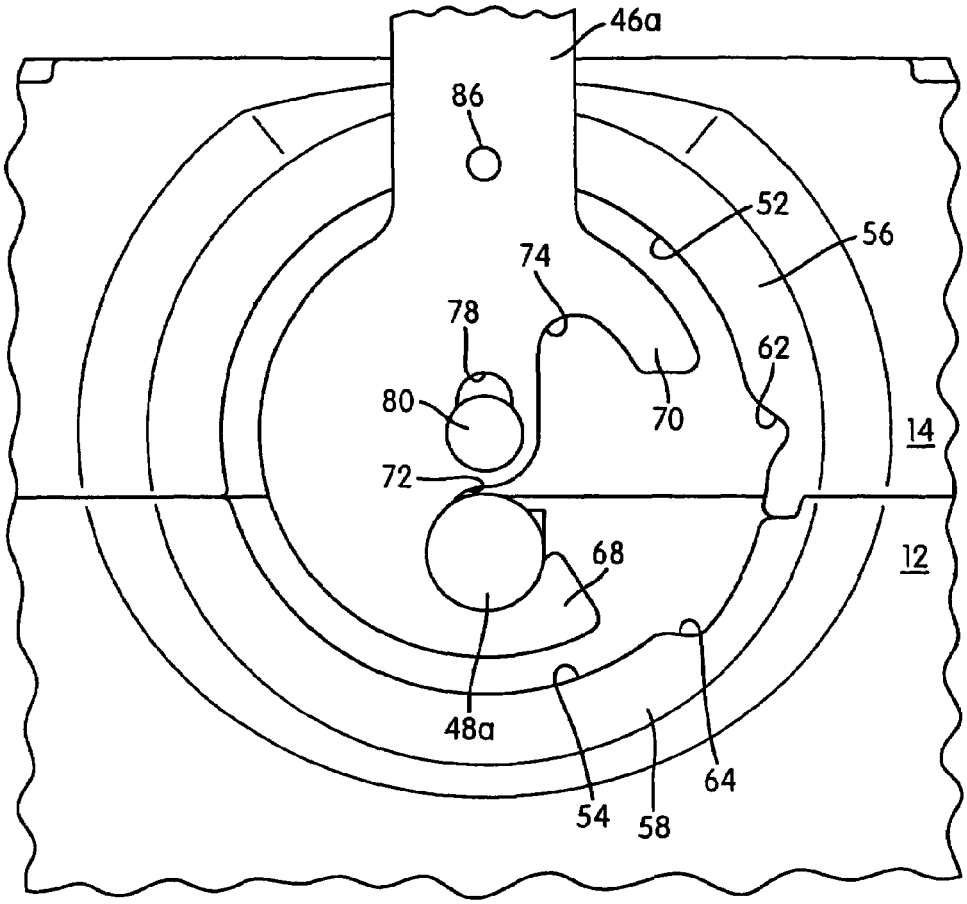
FIG. 14 is an enlarged side view illustrating the relation between the cover locking mechanism of the handle shown in FIG. 13 and the base and cover of the toolbox.

Operation of cover locking mechanisms 46*a*, 46*b* will now be described in greater detail. When the handle 42 is in the upright locked position, the locking pins 48*a*, 48*b* are received within the respective first recess 72 provided by the locking arm 68 of the cover locking mechanisms 46*a*, 46*b*. That is, the locking arm 68 engages the respective locking pin 48*a*, 48*b* such that the locking arm 68 extends under and around the respective locking pin 48*a*, 48*b*, as shown in FIG. 14. Thus, movement of the cover 14 to the open position is prevented because the handle 42, which is mounted to the cover 14, is interlocked with the locking pins 48*a*, 48*b*, which are mounted to the base 12. Further, the cover locking mechanisms 46*a*, 46*b* of the handle 42 are engaged with respective locking pins 48*a*, 48*b* of the base 12 such that the handle 42 carries the toolbox 10 from the base 12, which is the loaded portion.

Figure 15:
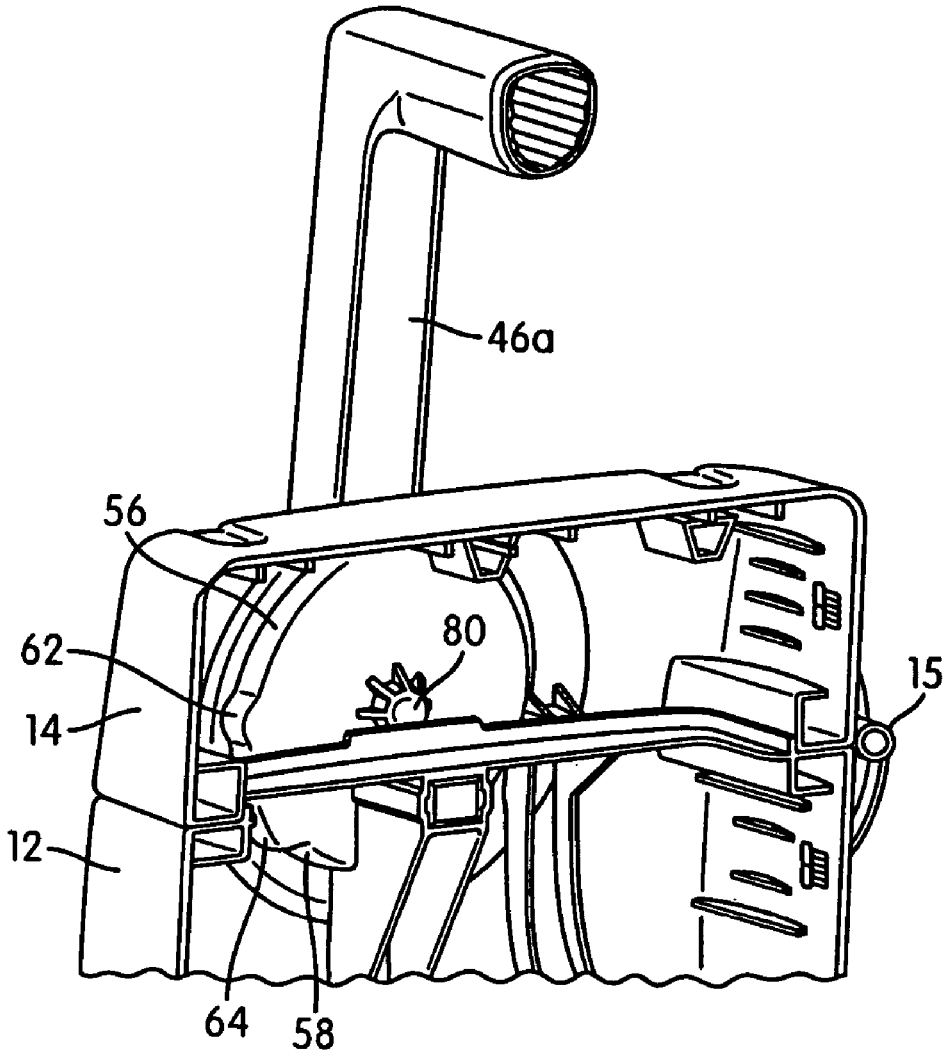
FIG. 15 is a partial cross-sectional view illustrating the relation between the cover locking mechanism of the handle shown in FIG. 13 and the base and cover of the toolbox.

As illustrated in FIGS. 14 and 15, when the handle 42 is in the upright locked position, the locating pin 86 is positioned within the first locating notch 60 to positively locate the handle 42 in the upright locked position thereof.

Figure 16:
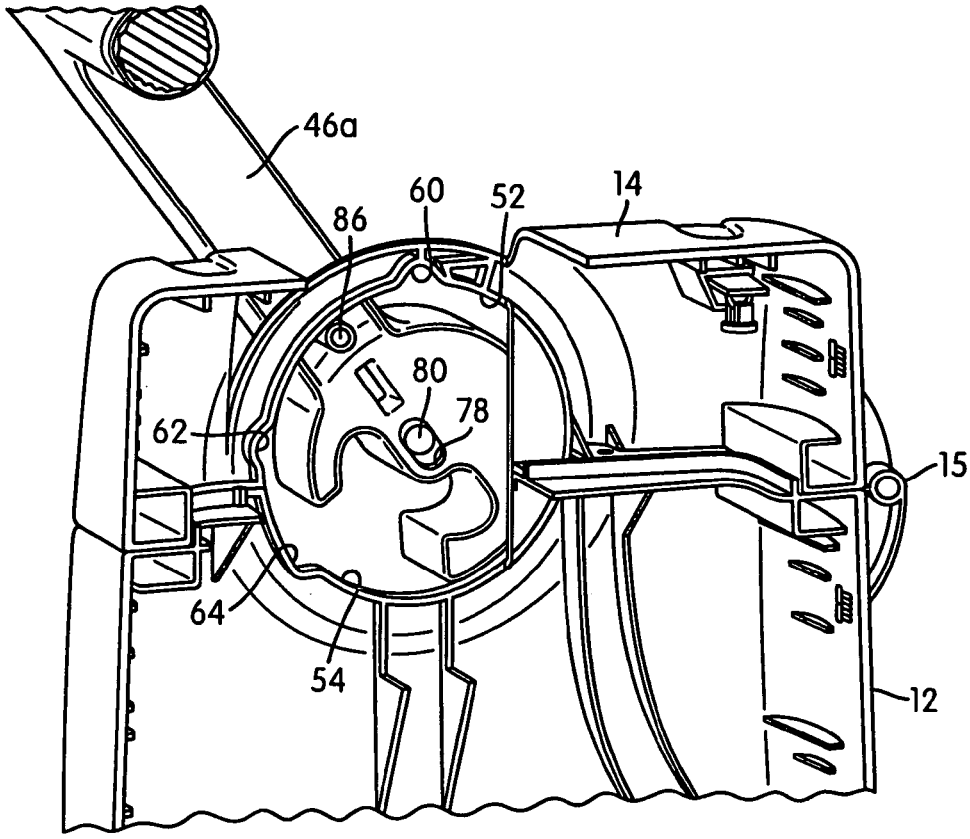
FIG. 16 is a partial cross-sectional view illustrating the cover locking mechanism of the handle shown in FIG. 14 being moved with respect to the base and cover of the toolbox.

Rotation of the handle 42 towards the intermediate unlocked position allows the cover locking mechanisms 46*a*, 46*b* to rotate about the axis of the pivot pin 80. As the handle 42 moves from the upright locked position towards the intermediate unlocked position as shown in FIG. 16, the locating pin 86 disengages from the first locating notch 60 against biasing thereof and moves towards the second locating notch 62 along the guide surface 52. As the locating pin 86 disengages from the first locating notch 60, the entire handle 42 moves inwardly towards the pivot pin 80 against biasing from spring 90.

As the handle 42 reaches the intermediate unlocked position, the spring 90 biases the locating pin 86, and hence the entire handle 42, outwardly away from the pivot pin 80 such that the locating pin 86 engages within the second locating notch 62 to positively locate the handle 42 in the intermediate unlocked position. In this position, the locking pins 48*a*, 48*b* are positioned between the locking arms 68, 70 of the respective cover locking mechanisms 46*a*, 46*b*. As a result, the cover locking mechanisms 46*a*, 46*b* are disengaged from respective locking pins 48*a*, 48*b* to allow the cover 14 to be moved with respect to the base 12. The user may use the handle 42 to lift and lower the cover 14 between the open and closed positions, respectively.

As the handle 42 moves from the intermediate unlocked position towards the folded locked position, the locating pin 86 disengages from the second locating notch 62 against biasing thereof and moves towards the third locating notch 64 along the guide surfaces 52, 54. As the locating pin 86 disengages from the second locating notch 62, the entire handle 42 moves inwardly towards the pivot pin 80 against biasing from spring 90.

As the handle 42 reaches the folded locked position, the spring 90 biases the locating pin 86, and hence the entire handle 42, outwardly away from the pivot pin 80 such that the locating pin 86 engages within the third locating notch 64 to positively locate the handle 42 in the folded locked position. In this position, the locking pins 48*a*, 48*b* are received within the second recess 74 provided by the locking arm 70 of respective cover locking mechanisms 46*a*, 46*b*. Thus, movement of the cover 14 to the open position is prevented because the cover locking mechanisms 46*a*, 46*b* of the handle 42 are interlocked with the locking pins 48*a*, 48*b* on the base 12. Rotation of the handle 42 in the opposite direction will rotate the handle 42 back towards the intermediate unlocked and upright locked positions.

In the illustrated embodiment, the cover locking mechanisms 46*a*, 46*b* are structured to provide three positions, i.e., the upright locked position, the intermediate unlocked position, and the folded locked position. However, the cover locking mechanisms 46*a*, 46*b* may be structured to provide only two positions, e.g., a locked position and an unlocked position. Alternatively, the cover locking mechanisms 46*a*, 46*b* may be structured to provide any suitable number of locked and unlocked positions. Also, the handle 42 may include a single cover locking mechanism or more than two cover locking mechanisms for locking the cover in the closed position.

Figure 17:
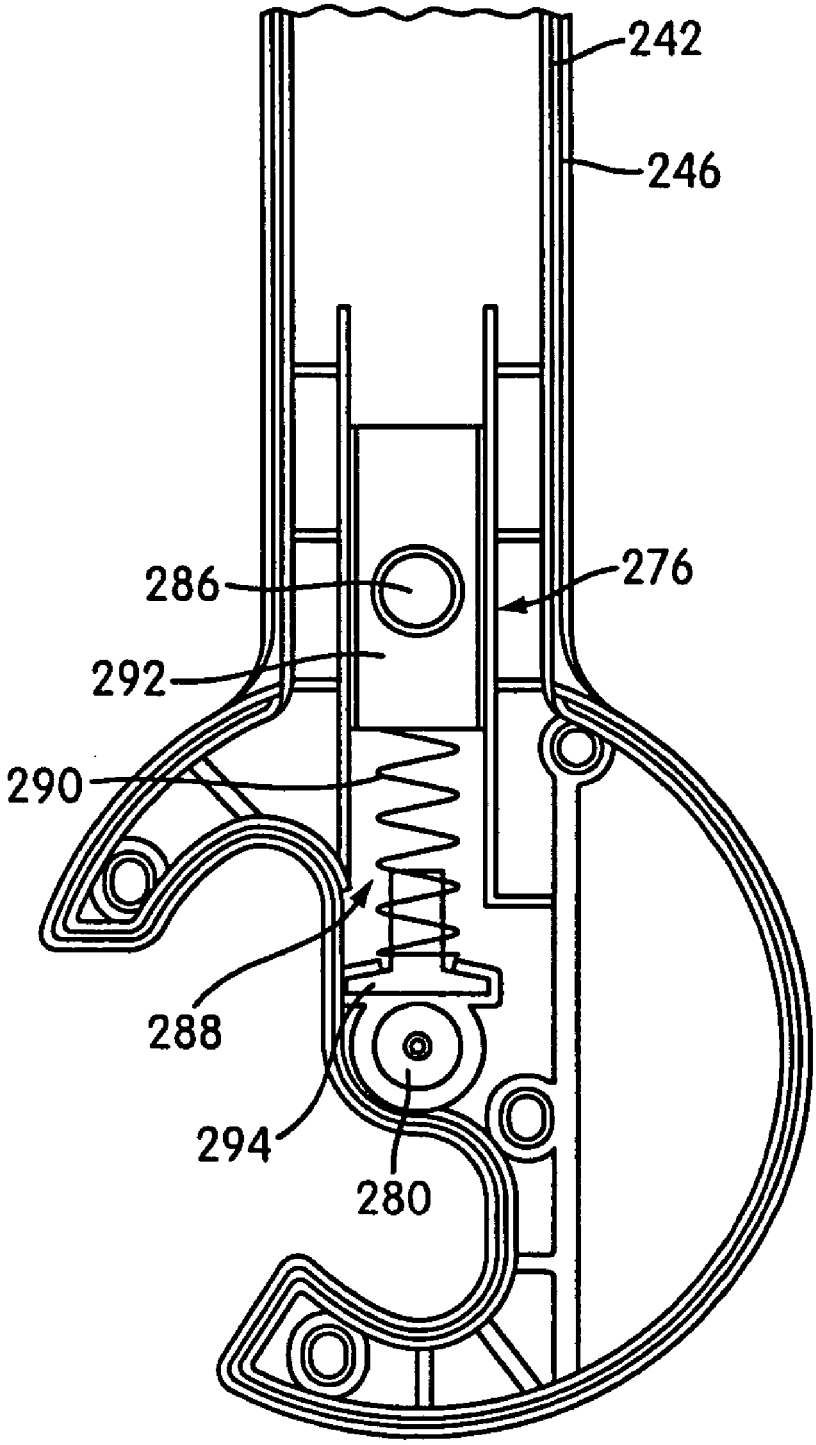
FIG. 17 is an enlarged interior side view of another embodiment of a cover locking mechanism of the handle.
Figure 18:
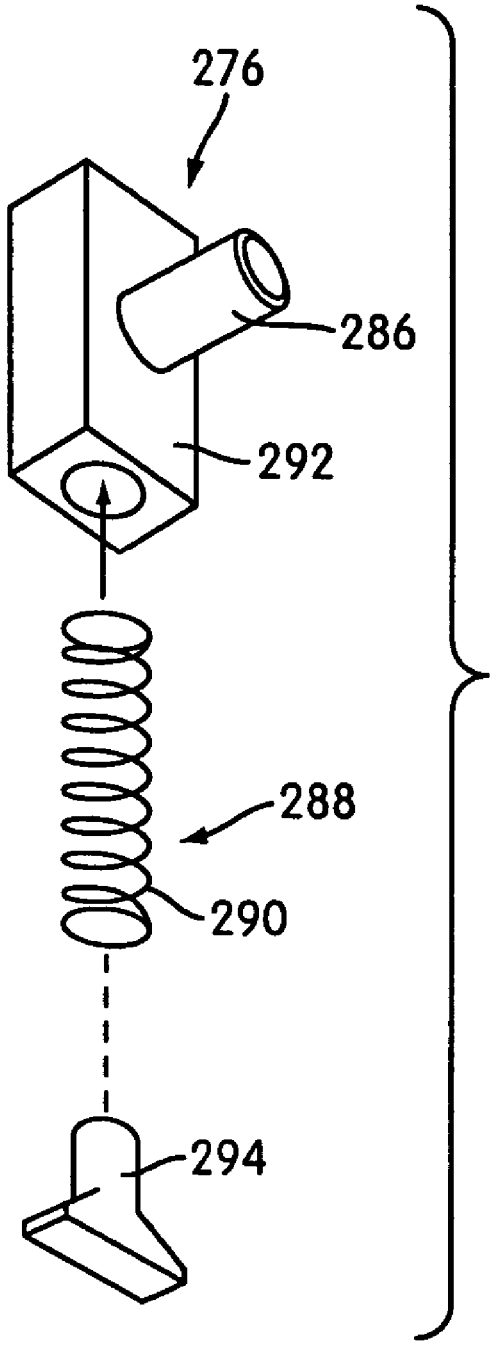
FIG. 18 is an exploded view of a portion of the cover locking mechanism shown in FIG. 17.

FIGS. 17 and 18 illustrate another embodiment of a handle locating assembly, indicated as 276. In this embodiment, the locating pin 286 thereof is a moving part, separate from the body of the respective locking mechanism 246. Specifically, the handle 242 is mounted via a pivot pin 280 to the cover for rotational movement only. The locating pin 286 is mounted on a slide structure 292 that is slidably mounted within the body of the locking mechanism 246. The locating pin 286 extends through an elongated slot in the body for movement relative to the body. A biasing structure 288 biases the slide structure 292 away from the pivot pin 280. The biasing structure 288 includes a spring base 294 supported on the pivot pin 280 and a spring 290 positioned between the spring base 294 and the slide structure 292. In use, the spring 290 biases the slide structure 292 and hence the locating pin 286 into engagement with guide surfaces provided on the cover and the base of the toolbox. As the handle 242 is rotated about the pivot pin 280 between positions, the locating pin 286 rides along the guide surfaces under biasing from the spring 290. When the locating pin 286 reaches a locating notch provided in the guide surfaces, biasing from the spring 290 forces the slide structure and hence the locating pin 286 into the respective locating notch to positively locate the handle 242 in position.

Figure 19:
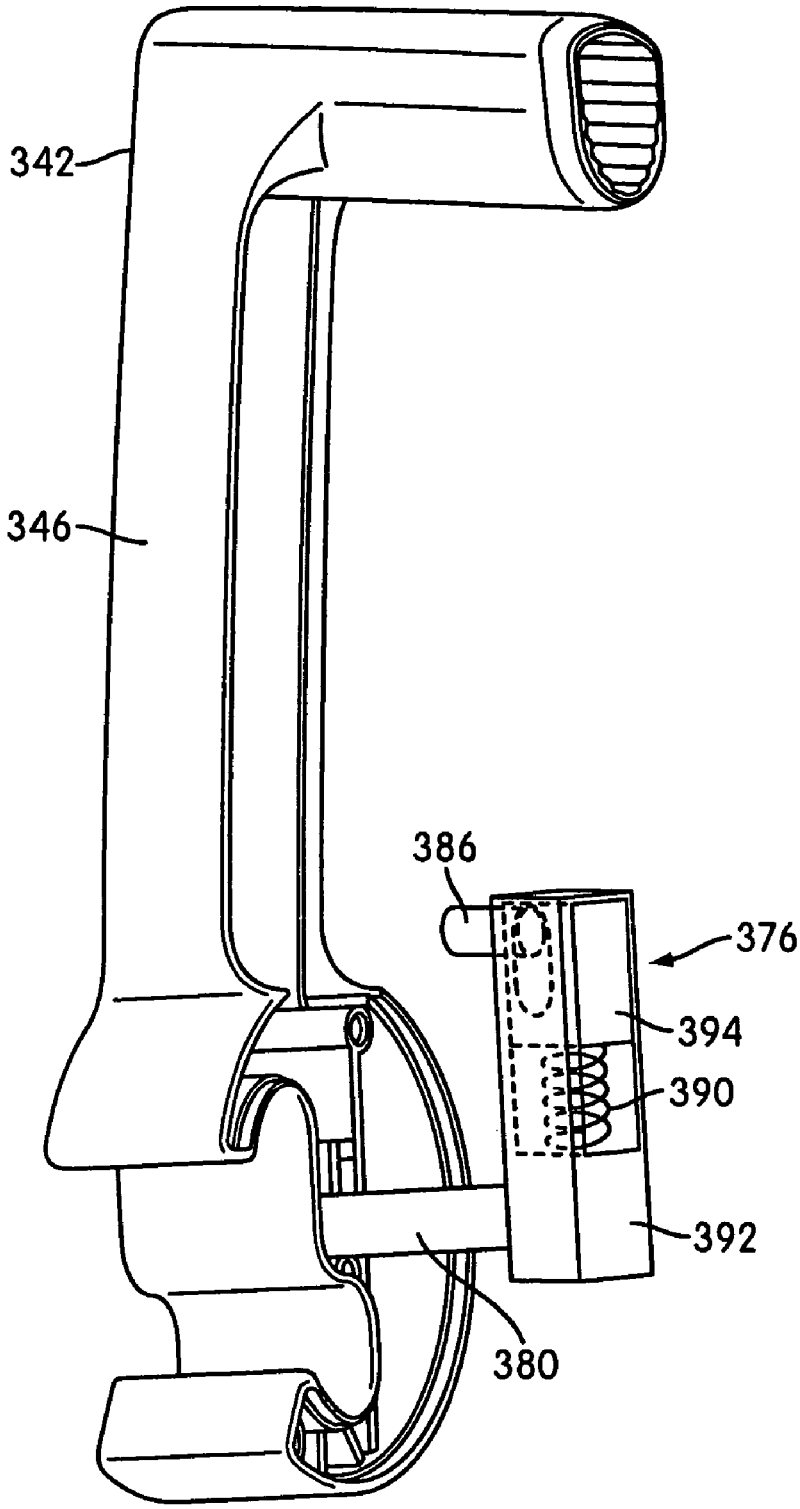
FIG. 19 is a perspective view of another embodiment of a cover locking mechanism of the handle.

FIG. 19 illustrates another embodiment of a handle locating assembly, indicated as 376. In this embodiment, the handle 342 is mounted via a pivot pin 380 to the cover for rotational movement only. A base structure 392 is mounted to the end of the pivot pin 380 for rotational movement along with the handle 342. A locating pin 386 is mounted on a slide structure 394 that is slidably mounted within the base structure 392. The locating pin 386 extends through an elongated slot in the base structure 392 for movement relative to the base structure 392. A spring 390 biases the slide structure 394 outwardly with respect to the pivot pin 380. In use, the spring 390 biases the slide structure 394 and hence the locating pin 386 into engagement with a guide surface provide on inner surfaces of the cover and the base. As the handle 342 is rotated between positions, the locating pin 386 rides along the guide surfaces under biasing from the spring 390. When the locating pin 386 reaches a locating notch provided in the guide surfaces, biasing from the spring 390 forces the slide structure 394 and hence the locating pin 386 into the respective locating notch to positively locate the handle 342 in position.

Figure 20:
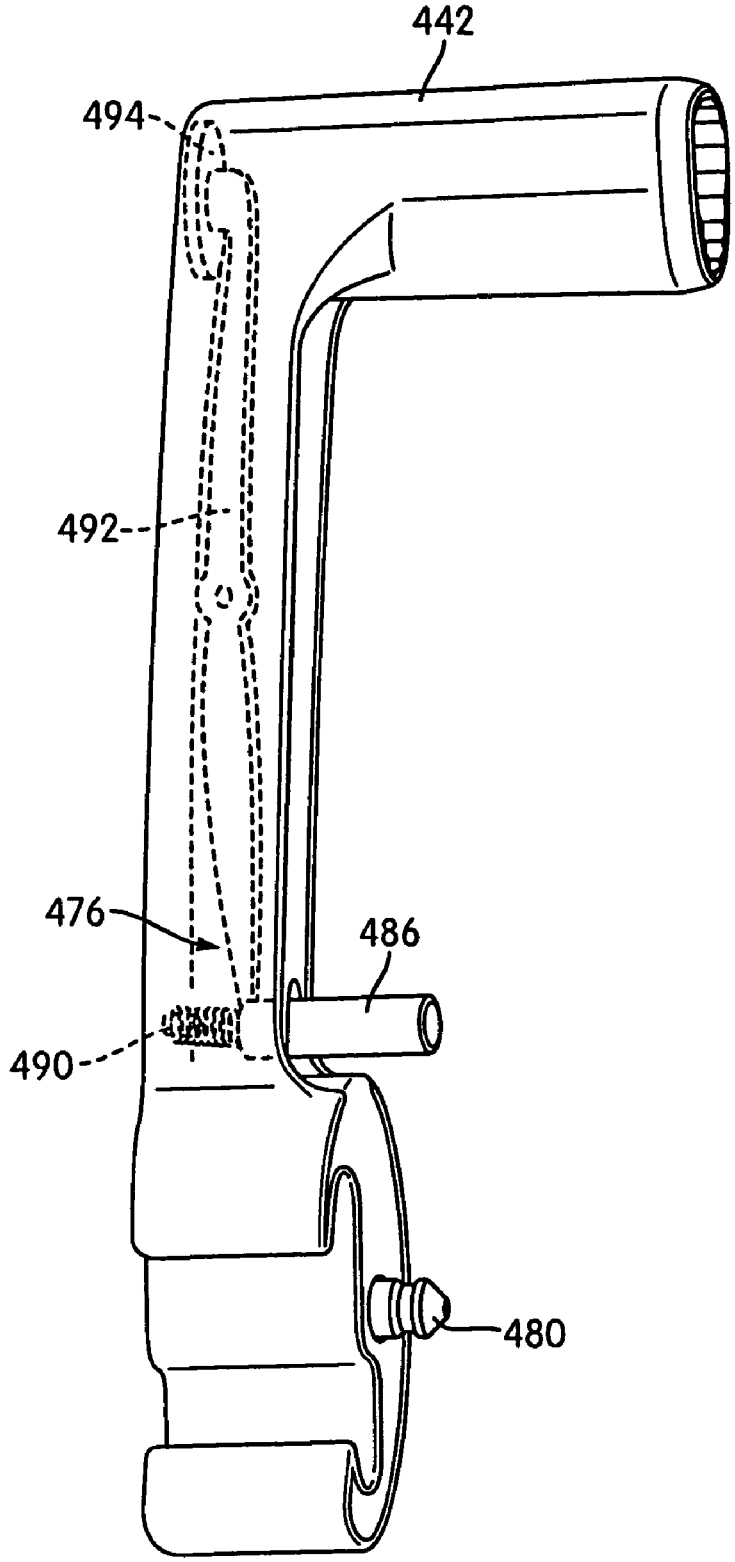
FIG. 20 is a perspective view of another embodiment of a cover locking mechanism of the handle.

FIG. 20 illustrates yet another embodiment of a handle locating assembly, indicated as 476. In this embodiment, the handle 442 is mounted via a pivot pin 480 to the cover for rotational movement only. The handle locating assembly 476 includes a lever 492 pivotally mounted within the body of the cover locking mechanism. One end of the lever 492 has a knob 494 that extends through a first opening in the body and the opposite end of the lever 492 has a locating pin 486 that extends through a second opening in the body. A spring 490 is engaged with the opposite end of the lever 492 to bias the locating pin 486 outwardly from the body. In use, the spring 490 biases the lever 492 and hence the locating pin 486 into engagement with guide surfaces provided on the cover and the base. As the handle 442 is rotated between positions, the locating pin 486 rides along the guide surfaces under biasing from the spring 490. When the locating pin 486 reaches a locating hole provided in the guide surface, biasing from the spring 490 forces the locating pin 486 into the respective locating hole to positively locate the handle 442 in position. The locating pin 486 may be released from the hole by manually pushing the knob 494 to pivot the lever 492 and hence move the locating pin 486 out of the respective hole.

It can thus be appreciated that the aspects of the present invention have been fully and effectively accomplished. The foregoing specific embodiments have been provided to illustrate the structural and functional principles of the present invention, and are not intended to be limiting. To the contrary, the present invention is intended to encompass all modifications, alterations, and substitutions within the spirit and scope of the appended claims.

What is claimed is:

1. A toolbox comprising:

a base having a bottom wall and side walls defining an interior storage compartment, at least one of the side walls having a locking element;

a single cover pivotally mounted to one of said side walls for pivotal movement as a whole between an open position in which access to the interior storage compartment is permitted and a closed position in which said single cover covers the interior storage compartment such that access to the interior storage compartment is prevented; and a handle including a handle portion and a cover locking mechanism, the handle being movably mounted to the cover so that the handle is movable to move the cover locking mechanism thereof into interlocking engagement with the locking element to lock the cover in the closed position, wherein the handle is pivotally mounted to the cover for movement between (1) a first locked position in which the handle portion is in a upright position for carrying by a user, and the cover locking mechanism interlocks with the locking element to lock the cover in the closed position, (2) an intermediate unlocked position in which the handle portion is in a position that permits opening and closing of the cover, and the cover locking mechanism is disengaged from the locking element on the base to allow movement of the cover between the open and closed positions thereof, and (3) a second locked position in which the handle portion is in a downward inclined position for storage purposes, and the cover locking mechanism interlocks with the locking element to lock the cover in the closed position, wherein the cover locking mechanism includes first and second locking arms that define respective first and second recesses, the locking element being received within one of the first and second recesses when the handle is in the first locked position and the locking element being received within the other of the first and second recesses when the handle is in the second locked position, and wherein the locking element being positioned between the first and second locking arms disengaged from the first and second recesses when the handle is in the intermediate unlocked position.

2. The toolbox according to claim 1, further comprising a handle locating assembly that locates the handle at discrete intervals in each of the first locked position, the intermediate unlocked position, and the second locked position.

3. A toolbox comprising:

a base having a bottom wall and side walls defining an interior storage compartment, at least one of the side walls having a locking element;

a single cover pivotally mounted to one of said side walls for pivotal movement as a whole between an open position in which access to the interior storage compartment is permitted and a closed position in which said single cover covers the interior storage compartment such that access to the interior storage compartment is prevented; and a handle including a handle portion and a cover locking mechanism, the handle being movably mounted to the cover so that the handle is movable to move the cover locking mechanism thereof into interlocking engagement with the locking element to lock the cover in the closed position, wherein the handle is pivotally mounted to the cover for movement between (1) a first locked position in which the handle portion is in a upright position for carrying by a user, and the cover locking mechanism interlocks with the locking element to lock the cover in the closed position, (2) an intermediate unlocked position in which the handle portion is in a position that permits opening and closing of the cover, and the cover locking mechanism is disengaged from the locking element on the base to allow movement of the cover between the open and closed positions thereof, and (3) a second locked position in which the handle portion is in a downward inclined position for storage purposes, and the cover locking mechanism interlocks with the locking element to lock the cover in the closed position, further comprising a handle locating assembly that locates the handle at discrete intervals in each of the first locked position, the intermediate unlocked position, and the second locked position, wherein the handle locating assembly includes a locating pin that is movable along with the handle, the locating pin engagable within (1) a first locating notch provided in one of the cover and the base to locate the handle in the first locked position, (2) a second locating notch provided in one of the cover and the base to locate the handle in the intermediate unlocked position, and (3) a third locating notch provided in one of the cover and the base to locate the handle in the second locked position.

4. The toolbox according to claim 3, wherein the cover and base provide guide surfaces that guide the locating pin between the first, second, and third locating notches.

5. The toolbox according to claim 4, wherein the guide surfaces of the cover and base cooperate to define a generally circular guide surface when the cover is in the closed position.

6. The toolbox according to claim 4, wherein the first, second, and third locating notches are provided in the guide surfaces of the cover and the base.

7. The toolbox according to claim 4, wherein the locating pin is biased into engagement with the guide surfaces of the cover and the base.

8. The toolbox according to claim 5, further comprising a biasing structure including a spring that biases the locating pin into engagement with the guide surfaces.

9. A container comprising:

a base having a bottom wall and side walls defining an interior storage compartment, at least one of the side walls having a locking element;

a single cover pivotally mounted to one of said side walls for pivotal movement as a whole between an open position in which access to the interior storage compartment is permitted and a closed position in which said single cover covers the interior storage compartment such that access to the interior storage compartment is prevented; and a handle including a handle portion and a cover locking mechanism, the handle being movably mounted to the cover so that the handle is movable to move the cover locking mechanism thereof into interlocking engagement with the locking element to lock the cover in the closed position, wherein the handle portion is constructed of metal and the cover locking mechanism is constructed of plastic.

10. A container comprising:

a base having a bottom wall and side walls defining an interior storage compartment, at least one of the side walls having a locking element;

a single cover movably mounted to the base for movement as a whole between an open position in which access to the interior storage compartment is permitted and a closed position in which access to the interior storage compartment is prevented;

a handle including a handle portion and a cover locking mechanism, the handle being pivotally mounted to the cover for movement between an unlocked position in which the cover locking mechanism thereof is disengaged from the locking element to allow movement of the cover between the open and closed positions thereof, and at least one locked position in which the cover locking mechanism interlocks with the locking element to lock the cover in the closed position; and a handle locating assembly including a locating pin that locates the handle at discrete intervals in each of the unlocked position and the at least one locked position, the locating pin being biased into engagement with guide surfaces provided on the cover and the base that guide the locating pin between the unlocked position and the at least one locked position.

11. The container according to claim 10, wherein the handle is pivotally mounted to the cover for movement between (1) a first locked position in which the handle portion is in a upright position for carrying by a user, and the cover locking mechanism interlocks with the locking element on the base to lock the cover in the closed position, (2) an intermediate unlocked position in which the handle portion is in a position that permits opening and closing of the cover, and the cover locking mechanism is disengaged from the locking element on the base to allow movement of the cover between the open and closed positions thereof, and (3) a second locked position in which the handle portion is in a downward inclined position for storage purposes, and the cover locking mechanism interlocks with the locking element on the base to lock the cover in the closed position.

12. The container according to claim 11, wherein the cover locking mechanism includes first and second locking arms that define respective first and second recesses, the locking element being received within one of the first and second recesses when the handle is in the first locked position and the locking element being received within the other of the first and second recesses when the handle is in the second locked position, and wherein the locking element being positioned between the first and second locking arms disengaged from the first and second recesses when the handle is in the intermediate unlocked position.

13. The container according to claim 11, wherein the locating pin is engagable within (1) a first locating notch provided in the guide surfaces to locate the handle in the first locked position, (2) a second locating notch provided in the guide surfaces to locate the handle in the intermediate unlocked position, and (3) a third locating notch provided in the guide surfaces to locate the handle in the second locked position.

14. The container according to claim 10, wherein the guide surfaces of the cover and base cooperate to define a generally circular guide surface when the cover is in the closed position.

15. The container according to claim 10, wherein the handle portion is constructed of metal and the cover locking mechanism is constructed of plastic.

16. The container according to claim 10, wherein the handle includes a pair of cover locking mechanisms, one of the pair of cover locking mechanisms mounted to one end of the handle portion and the other of the pair of cover locking mechanisms mounted to an opposite end of the handle portion.

17. The container according to claim 16, wherein each of the pair of cover locking mechanisms has generally L-shaped body.

18. The container according to claim 10, further comprising a biasing structure including a spring that biases the locating pin into engagement with the guide surfaces.

19. A container comprising;

a base having a bottom wall and side walls defining an interior storage compartment;

a cover pivotally mounted to the base for pivotal movement between an open position in which access to the interior storage compartment is permitted and a closed position in which access to the interior storage compartment is prevented, said cover and said base cooperating to form an exterior surface of said container when the cover is in the closed position, said exterior surface having a pair of lock elements formed thereon on opposite sides of said container;

a handle including a pair of lock portions, said handle being movable between a first position in which said lock portions engage said lock elements to lock said cover in said closed position, and a second position in which said lock portions disengage said lock elements to unlock said cover, said lock portions being disposed exteriorly to said interior storage compartment when said handle is in said first position, wherein when the handle is in the first position, the lock portions engage the lock elements in an interlocking relationship that inhibits pivotal movement towards the second position, and prevents pivotal movement towards a direction opposite said second position.

* * * * *